US008087469B1

(12) United States Patent
Bugeja

(10) Patent No.: US 8,087,469 B1
(45) Date of Patent: Jan. 3, 2012

(54) POST AND DRAINAGE HOLE DIGGER

(76) Inventor: Edward Leone Bugeja, Chesapeake, VA (US)

( * ) Notice: Subject to any disclaimer, the term of this patent is extended or adjusted under 35 U.S.C. 154(b) by 0 days.

(21) Appl. No.: 12/384,818

(22) Filed: Apr. 9, 2009

(51) Int. Cl.
*A01B 45/00* (2006.01)

(52) U.S. Cl. ..... 172/22; 172/371

(58) Field of Classification Search ..... 172/371–381, 172/21, 22; D8/7; 37/213; 175/18
See application file for complete search history.

(56) References Cited

U.S. PATENT DOCUMENTS

| | | | | |
|---|---|---|---|---|
| 281,137 | A | 7/1883 | Rhodes | |
| 429,903 | A | 6/1890 | Gregg | |
| 1,222,711 | A | 4/1917 | Armstrong, Sr. | |
| 1,639,939 | A * | 8/1927 | Grothe | 175/385 |
| 2,733,047 | A * | 1/1956 | Morgan | 175/18 |
| 2,735,712 | A | 2/1956 | Hart | |
| 2,896,729 | A * | 7/1959 | Brechlin | 172/19 |
| 3,051,253 | A * | 8/1962 | McCann | 175/18 |
| 3,080,006 | A * | 3/1963 | Brolin | 175/18 |
| 3,131,777 | A * | 5/1964 | Snider | 175/18 |
| 3,382,937 | A * | 5/1968 | Watts | 175/323 |
| 3,387,674 | A * | 6/1968 | Watson | 175/394 |
| 3,422,915 | A * | 1/1969 | Watts | 175/388 |
| 4,042,270 | A | 8/1977 | Welland | |
| 4,213,504 | A * | 7/1980 | Schneider | 172/25 |
| 4,290,245 | A | 9/1981 | Pardue et al. | |
| 4,659,127 | A * | 4/1987 | Hancovsky | 294/50.7 |
| 5,669,648 | A | 9/1997 | Luck | |
| 5,743,579 | A | 4/1998 | Ranburger | |
| 6,068,315 | A | 5/2000 | Vaughter | |
| 6,595,298 | B1 * | 7/2003 | Crady | 172/41 |
| 6,739,412 | B2 * | 5/2004 | Shotton | 175/57 |
| 6,955,227 | B1 * | 10/2005 | Motosko | 172/25 |
| 7,461,880 | B2 | 12/2008 | Norton et al. | |
| 2007/0212179 | A1 * | 9/2007 | Khangar et al. | 408/204 |

* cited by examiner

*Primary Examiner* — Robert Pezzuto
*Assistant Examiner* — Matthew D Troutman

(57) ABSTRACT

The Post and Drainage Hole Digger is designed to manually dig shallow holes in the earth for posts or deeper holes for drainage or shallow wells. It is a modification of an existing device called an earth anchor used for anchoring situations such as storage sheds and guying applications. The invention is comprised of a steel disk screw mechanism, a steel shaft to which the steel disk is welded at one end and an attaching mechanism is incorporated at the other end, a U-shaped steel cutting bar welded to the shaft and the disk, a steel cutting tooth bent downward and welded to the disk, a detachable turning handle connected to the shaft via the attaching mechanism, and extension(s) that can be inserted between the main shaft and the turning handle.

2 Claims, 2 Drawing Sheets

POST AND DRAINAGE HOLE DIGGER

CROSS-REFERENCE TO RELATED APPLICATIONS

U.S. PATENT DOCUMENTS

| | | |
|---|---|---|
| 281,137 | Jul. 10, 1883 | W.H. Rhodes |
| 429,903 | Jun. 10, 1890 | S.H. Gregg |
| 1,222,711 | Apr. 17, 1917 | J.J. Armstrong, Sr |
| 2,735,712 | Feb. 21, 1956 | C.W. Hart |
| 4,042,270 | Aug. 16, 1977 | Edward E. Welland |
| 4,290,245 | Aug. 22, 1981 | James I. Pardue<br>William M. Hornsby<br>Henry J. Noble |
| 5,669,648 | Aug. 23, 1997 | Michael Lewis Luck |
| 5,743,579 | Apr. 28, 1998 | Carl W. Ranburger |
| 6,068,315 | May 30, 2000 | Jeffrey L. Vaughter |
| 7,461,880 B2 | Dec. 9, 2008 | Jeffrey M. Norton<br>Barry R. Albert |

INTERNATIONAL PATENT DOCUMENTS

Description

Background of the Invention

1. Field of Endeavor

The present invention generally relates to manually operated hole diggers that are normally used to dig shallow holes in the earth for posts and deeper holes in the earth for drainage or shallow wells. The present invention more specifically relates to a helical disk type hole digger that enables a user to conveniently and economically produce a vertical hole in the ground.

2. Description of Prior Art

Traditional post hole diggers include two concave blades that face one another to form a cylindrical region generally about six inches in diameter. The blades are pivotally connected to one another at the top portion of the blades. Extending from each blade is a fixture or cap supporting a shaft handle extending approximately four feet in height. By thrusting the blades into the ground and moving the upper end of the handles away from one another the blades pivot inward to secure the earth between the blades. As the hole becomes deeper, the pivoting motion of the blades results in the shafts contacting the edge of the hole at the top of the hole. This minimizes the pivoting motion of the blades and thereby reduces the amount of dirt that can be pulled out. The user is forced to widen the width of the hole in order to accommodate the shafts. The undesirable result is a cone shaped hole that gets larger as the hole gets deeper. Many post hole diggers modify the traditional concave blade approach to include a variety of handle designs that attempt to minimize or eliminate this undesirable effect. Unfortunately, many of these designs cannot compete with the traditional design because they appear to be expensive to produce. Other designs that appear to be economical to produce, are only somewhat effective.

Single flight augers are effective hole diggers that work well when power driven. Unfortunately, they are expensive devices that do not work as well when manually operated. Most auger type hole diggers work best in loose, well aerated soils but the true test of their effectiveness is how well they work in damp or wet clay. When single flight augers are manually screwed into damp or wet clay they can get stuck and be difficult to remove.

Accordingly, a need exists to provide an economical manually operated hole digger that digs a cylindrical hole for posts and deeper holes that can be used for drainage or shallow wells that work well in damp or wet clay, loam, or sand without having to increase the diameter of the hole opening as the depth of the hole increases. It is the object of this invention to provide these advantageous features. The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

SUMMARY

The Post and Drainage Hole Digger is designed to manually dig shallow holes in the earth for posts or deeper holes for drainage or shallow wells. It is effective in damp or wet clay, loam, and sand. It is a modification of an existing device called an earth anchor used for imbedding within the earth to acquire a secure and snug retention therein. This invention has a steel disk that is similar to the one used on the earth anchor. It has a shaft hole at its center and a radial cut that is bent at the radial cut to form the screw mechanism. A steel shaft that contains an attaching mechanism at one end of the shaft is welded to the steel disk at the other end. A U-shaped steel cutting bar is welded to the shaft and the disk. A steel cutting tooth is angled downward and welded to the disk. A detachable turning handle is connected to the shaft. As the steel disk is turned into the ground, the cutting tooth angled downward provides additional bite needed to screw the steel disk into the ground and provides turbulence of the soil below the disk by pushing the soil forward and upward. This introduces air into the soil and breaks the seal between the bottom of the disk and the soil below. The U-shaped cutting bar cuts the earth and introduces an air gap along the circumference of the disk. The shaft is turned until a plug of earth fills the U-shaped cutting bar area. The tool and plug are pulled out of the hole, the plug is removed, and the operation is repeated until the desired depth is reached. Extension(s) can be inserted between the main shaft and the turning handle to dig deeper holes.

DESCRIPTION OF THE DRAWINGS

These features and advantages will be understood in light of the following drawings of the Post and Drainage Hole Digger.

DETAILED DESCRIPTION OF THE INVENTION

Figure 1:
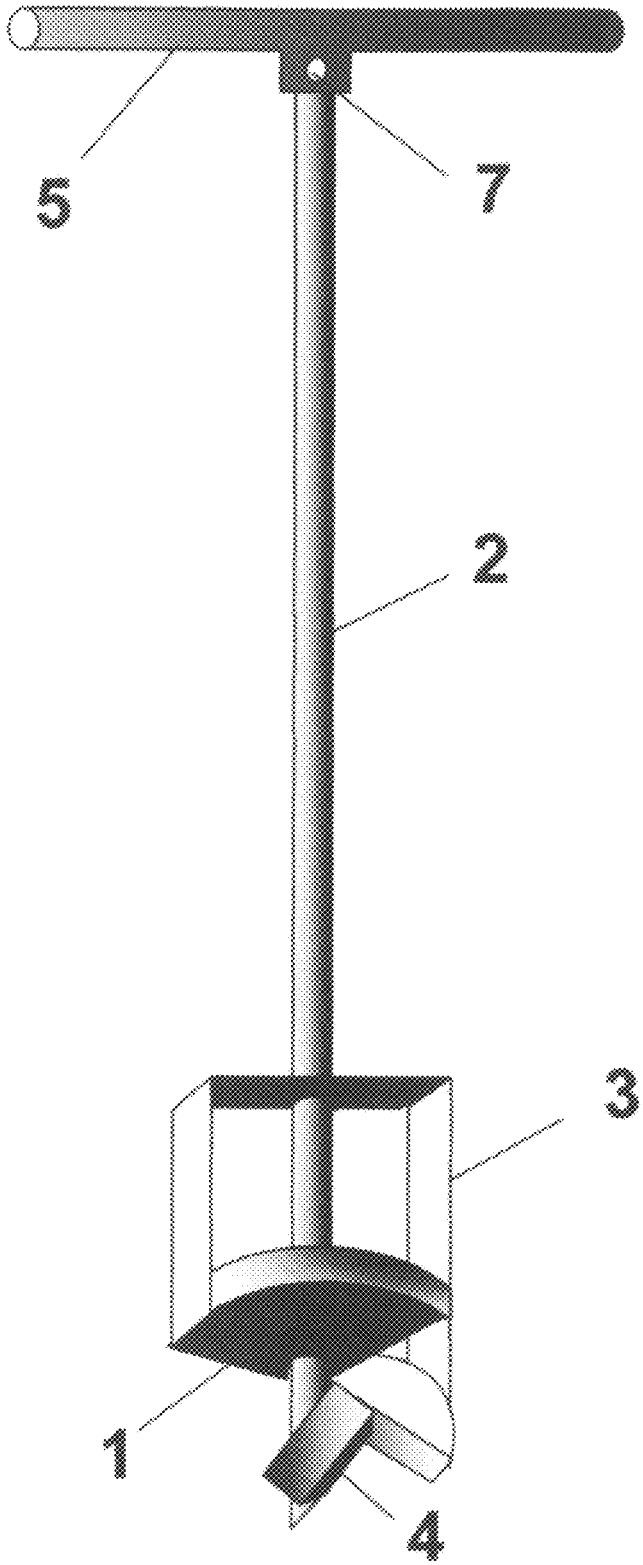
FIG. 1 is a perspective side-view of the Post and Drainage Hole Digger
Figure 2:
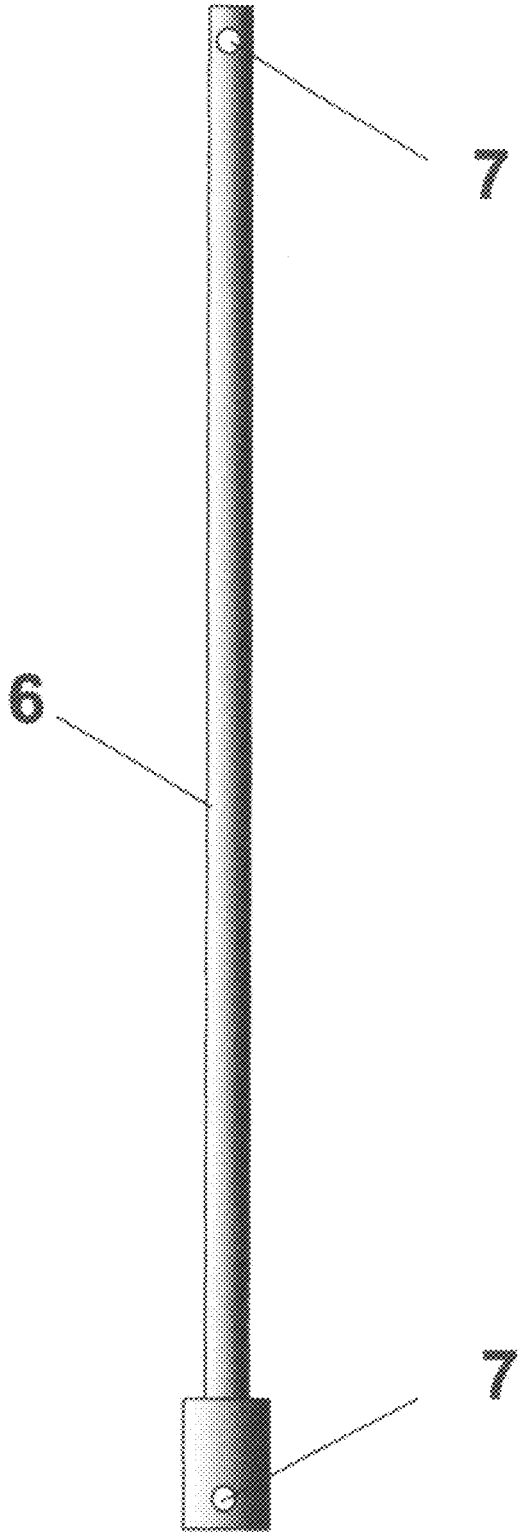
FIG. 2 is a side-view of the Post and Drainage Hole Digger Extension(s).

The Post and Drainage Hole Digger is a device for manually digging holes in the earth through damp or wet clay, loam, and sand. It is a modification of an existing device called an earth anchor used for imbedding within the earth to acquire a secure and snug retention therein. This invention consists of a steel disk 1 as shown in FIG. 1 that is similar to the one used on the earth anchor. It has a shaft hole at its center and a radial cut that is bent at the radial cut to form the screw mechanism. It also consists of a steel shaft 2, shown in FIG. 1, to which the steel disk is welded near one end and an attaching means 7 is incorporated at the other end. A U-shaped steel cutting bar 3, with a hole drilled in the bottom of the U and one leg longer than the other, is fabricated. The shaft 2 is placed through the hole in the U-shaped cutting bar 3 such that the ends of the legs contact the steel disk 1 at two diametrically opposed points as shown in the FIG. 1. The width of the legs is set to cause at least a ¼ inch compression of the plug being cut. This introduces an air gap around the perimeter of the plug. The thickness of the legs is set to provide low resistance but adequate strength. The cutting bar 3 is then welded to the shaft 2 and the disk 1. A steel cutting tooth 4 is angled downward and welded to the disk 1 as shown in FIG. 1. It is positioned directly adjacent to the shaft, has a width that is ¼ to ½ of the radius of the helical disk, and is angled about 45 degrees downward relative to a plane perpendicular to the shaft. This cutting tooth 4 provides the additional bite needed to screw the steel disk 1 into the ground and provides turbulence of the soil below the disk by pushing the soil forward and upward. This introduces air into the soil and helps breaks the seal between the bottom of the disk and the soil below. The disk 1, cutting bar 3 and cutting tooth 4 all have beveled edges to form sharp edges that cut into the earth. A detachable turning handle 5 as shown in FIG. 1 is connected to the shaft 2. As the steel disk 1 is turned into the ground, the U-shaped cutting bar 3 cuts and compresses the earth along the circumference of the disk 1. The shaft 2 is turned until a plug of earth fills the U-shaped cutting bar 3 area. The air gap introduced around the perimeter of the plug and the air introduced beneath the disk allow the tool and plug to be pulled out of the hole. The operation is repeated until the desired depth is reached. The extension(s) 6 shown in FIG. 2 can be inserted between the main shaft 2 and the turning handle 5 to dig deeper holes. The turning handle and extensions have attaching means 7 incorporated for quick and easy connection and removal.

While the present invention has been described in terms of the preferred embodiment, other similar embodiments may be used for performing the same function. Therefore, the present invention should be construed in breath and scope in accordance with the recitation of the appended claims.

What is claimed is:

1. A hand-held manual hole digger for digging holes in damp or wet clay, loam and sand soils, comprising:

an elongated shaft;

a detachable handle to be attached at the top of said elongated shaft, wherein said handle is formed of a generally cylindrical rod having a socket formed halfway between the ends thereof to receive the upper end of said elongated shaft;

a helical steel disk mounted adjacent the bottom of said elongated shaft, wherein said helical disk has a shaft hole at its center and a radial cut, wherein said helical disk is bent at said radial cut to form a continuous inclined spiral, wherein said inclined spiral completes a full 360 degree rotation with no gaps in said helical disk, wherein said helical disk has a beveled cutting edge, and wherein said helical disk is welded to the bottom of said elongated shaft;

an inverted U-shaped cutting bar attached to said elongated shaft and said helical disk, wherein said U-shaped cutting bar comprises first and second flat rectangular side legs and a flat rectangular upper portion, wherein said upper portion of said inverted U-shaped cutting bar has a hole located in its center to receive said elongated shaft therein, wherein said first side leg is shorter than said second side leg;

wherein said first and second side legs each have an inner surface facing said elongated shaft, wherein said inner surface of said first side leg is welded to the circumferential surface of said helical disk at a first location adjacent the bottom of said first side leg, wherein said inner surface of said second side leg is welded to said circumferential surface of said helical disk at a second location adjacent the bottom of said second side leg, wherein said first and second locations are at two generally diametrically opposed locations on said helical disk;

wherein the edges of said first and second side legs are beveled;

a single generally rectangular cutting tooth attached to said helical disk, wherein said cutting tooth is attached to the cutting edge of said helical disk directly adjacent to said elongated shaft, wherein said cutting tooth has a width that is approximately ⅓ the radius of said helical disk and forms approximately a 45 degree downward angle relative to a plane perpendicular to said elongated shaft, wherein said cutting tooth forms an L-shape with the lower cutting edge of said helical disk, wherein said cutting tooth has a beveled lower edge; and one or more extensions and means for attachment and detachment of said extensions between said handle and said elongated shaft.

2. A method for manually digging a hole in damp or wet clay, loam, and sand soils, the method comprising the steps of i) providing a hand-held manual hole digger comprising:

an elongated shaft;

a detachable handle to be attached at the top of said elongated shaft, wherein said handle is formed of a generally cylindrical rod having a socket formed halfway between the ends thereof to receive the upper end of said elongated shaft;

a helical steel disk mounted adjacent the bottom of said elongated shaft, wherein said helical disk has a shaft hole at its center and a radial cut, wherein said helical disk is bent at said radial cut to form a continuous inclined spiral, wherein said inclined spiral completes a full 360 degree rotation with no gaps in said helical disk, wherein said helical disk has a beveled cutting edge, and wherein said helical disk is welded to the bottom of said elongated shaft;

an inverted U-shaped cutting bar attached to said elongated shaft and said helical disk, wherein said U-shaped cutting bar comprises first and second flat rectangular side legs and a flat rectangular upper portion, wherein said upper portion of said inverted U-shaped cutting bar has a hole located in its center to receive said elongated shaft therein, wherein said first side leg is shorter than said second side leg;

wherein said first and second side legs each have an inner surface facing said elongated shaft, wherein said inner surface of said first side leg is welded to the circumferential surface of said helical disk at a first location adjacent the bottom of said first side leg, wherein said inner surface of said second side leg is welded to said circumferential surface of said helical disk at a second location adjacent the bottom of said second side leg, wherein said first and second locations are at two generally diametrically opposed locations on said helical disk;

wherein the edges of said first and second side legs are beveled;

a single generally rectangular cutting tooth attached to said helical disk, wherein said cutting tooth is attached to the cutting edge of said helical disk directly adjacent to said elongated shaft, wherein said cutting tooth has a width that is approximately ⅓ the radius of said helical disk and forms approximately a 45 degree downward angle relative to a plane perpendicular to said elongated shaft, wherein said cutting tooth forms an L-shape with the lower cutting edge of said helical disk, wherein said cutting tooth has a beveled lower edge; and one or more extensions and means for attachment and detachment of said extensions between said handle and said elongated shaft;

ii) placing said hole digger on the ground and rotating the handle until a plug is formed iii) lifting the said hole digger and plug out of the ground and discarding said plug iiii) repeating the last two steps until the desired depth is reached.

* * * * *